US007147518B2

(12) United States Patent
Marechal et al.

(10) Patent No.: US 7,147,518 B2
(45) Date of Patent: Dec. 12, 2006

(54) ELECTRICAL CONNECTION DEVICE PROVIDED WITH AT LEAST ONE TUBULAR END CONTACT

(75) Inventors: Gilles Marechal, Paris (FR); Joseph Crestin, Vanves (FR); Fabrice Gilet, Villiers-sur-Marne (FR)

(73) Assignee: Société d' Exploitation des Procédés Maréchal (SEPM), Saint Maurice (FR)

( * ) Notice: Subject to any disclaimer, the term of this patent is extended or adjusted under 35 U.S.C. 154(b) by 0 days.

(21) Appl. No.: 10/853,109

(22) Filed: May 26, 2004

(65) Prior Publication Data

US 2004/0266260 A1 Dec. 30, 2004

(30) Foreign Application Priority Data

May 27, 2003 (FR) ..... 03 06394

(51) Int. Cl.
*H01R 24/00* (2006.01)
*H01R 13/40* (2006.01)

(52) U.S. Cl. ..... 439/675; 439/578

(58) Field of Classification Search ..... 439/578, 439/585, 675, 676, 135, 750
See application file for complete search history.

(56) References Cited

U.S. PATENT DOCUMENTS 2,225,461 A * 12/1940 Reynolds ..... 439/675
4,012,105 A * 3/1977 Biddle ..... 439/675
4,545,633 A * 10/1985 McGeary ..... 439/675
4,690,481 A 9/1987 Randolph
5,346,406 A 9/1994 Hoffman et al.
5,478,249 A 12/1995 Crestin
5,703,324 A 12/1997 Harder
5,759,069 A 6/1998 Kitatani et al.
5,879,198 A 3/1999 Sekimori et al.
5,971,810 A 10/1999 Taylor ..... 439/675
6,241,559 B1 6/2001 Taylor ..... 439/675

FOREIGN PATENT DOCUMENTS

DE 19638157 3/1997
EP 0805526 5/1997
FR 2703844 10/1994

* cited by examiner

*Primary Examiner*—Briggitte R. Hammond
(74) *Attorney, Agent, or Firm*—Greenblum & Bernstein, P.L.C.

(57) ABSTRACT

An electrical connection device including a socket having at least one axial pressure contact arranged in insulation and at least one annular groove. A plug has at least one tubular contact that is coaxial about a direction of coupling of the plug with the socket. The at least one tubular contact includes a leading end having an end surface. The at least one tubular contact is structured and arranged to co-operate with the at least one axial pressure contact of the socket. The at least one annular groove opens out axially and is structured and arranged to receive therein the at least one tubular contact. At least a portion of the end face of the leading end of the at least one tubular contact presses against the at least one axial pressure contact when the at least one tubular contact is positioned in the at least one annular groove and when the plug is coupled with the socket.

21 Claims, 3 Drawing Sheets

ELECTRICAL CONNECTION DEVICE PROVIDED WITH AT LEAST ONE TUBULAR END CONTACT

CROSS-REFERENCE TO RELATED APPLICATIONS

The present application claims priority under 35 U.S.C. §119 of French Patent Application No. 0306394, filed on May 27, 2003, the disclosure of which is expressly incorporated by reference herein in its entirety.

BACKGROUND OF THE INVENTION

1. Field of the Invention

The invention relates to an electrical connection device constituted by an active socket and a plug provided with at least one contact that is designed to co-operate with an opposing contact of the socket arranged in insulation, which insulation is provided with at least one passage for introducing said contact of the plug while coupling the plug with the socket.

The connection devices to which the invention relates are in particular plug and socket-outlets, cable couplers, and appliance couplers.

2. Discussion of Background Information

Such connection devices present numerous problems for solving as a function of their applications, and in particular safety problems.

In particular, in order to comply with the standards that are in force for guaranteeing the safety of people and property, it is known that electrical appliances must provide at least some minimum degree of protection against access to live parts.

In order to verify that such protection is indeed provided, use is made of an articulated test finger as defined by a standard.

Testing consists in not being able to make contact between the standardized test finger and the live parts of the appliance under test while attempting to insert the test finger in all possible positions, said test being particularly difficult to satisfy when high-current electricity is involved.

In addition, it is also clear that a plug must not be capable of coupling with a socket unless they are mutually electrically compatible so that the currents and/or voltages and/or electrical power levels correspond between the two connection elements.

For this purpose, it is desired to use mechanical means to prevent two connection elements that are mutually electrically incompatible being coupled together, with this being made more difficult by the fact that the component parts of such elements are standardized, in particular for reasons of cost.

Furthermore, certain connection devices require or recommend the use of pilot contacts serving, for example, to control the flow of electricity remotely. Unfortunately, conventional devices, and in particular single-pole appliance couplers, often do not have sufficient space for receiving pilot contacts.

The inventors have devised a contact that serves specifically to solve several of the problems posed simultaneously.

Document DE-196 38 157 and members of its family, such as document U.S. Pat. No. 5,759,069 A describe an electrical connection device for audio or similar types of appliance in which the problems to be solved do not relate to safety nor to the other problems mentioned above, because of the low currents used.

SUMMARY OF THE INVENTION

In order to solve these problems and make it possible to devise a connection device having the advantages of end-pressure contacts, the invention proposes a connection device of the above-specified prior art type, constituted by an active socket and a plug provided with at least one tubular contact that is coaxial about the direction for coupling the plug with the socket, and that is designed to co-operate with an opposing contact of the socket arranged in insulation, which insulation is provided with at least one passage in the form of an annular groove for introduction of said contact of the plug while the plug is being coupled with the socket, the device being remarkable in particular in that each contact of the socket is in the form of an axial pressure contact, and each passage in the form of an annular groove in the insulation is designed to pass a single plug contact by also opening out axially, at least in part, in the vicinity of said socket contact, each plug contact co-operating with the corresponding socket contact via at least a portion of the end face of its leading end that presses against said socket contact.

It will be understood that under such circumstances, it is possible in astute and advantageous manner to comply with the above-mentioned test-finger tests, because the passage made in the insulation of the socket is reduced merely to an annular groove, whereas the above-mentioned prior art device would only point the inventors away from the solution, since the prior art device relates essentially to a plug, and accessibility to the contacts of the socket by a test finger is not a problem to be solved with that prior art device.

In the invention, such a tubular contact and the annular groove of the socket can simultaneously constitute means for mechanically encoding compatibility between the plug and the socket, since in order for it to be possible to couple a plug with a socket, it is necessary for the tubular contact of the plug to be capable of being introduced into the annular groove of the socket.

Tubular contacts also make it possible to couple elements without imposing any particular angular orientation on the plug and the socket, which is very advantageous, particularly when using thick cables since any twisting is avoided.

Finally, tubular contacts also make it possible to release inside space within each contact that can advantageously be used, e.g. for receiving pilot contacts.

Although the invention relates to all types of connection device whether multi-pole or otherwise, it is particularly advantageous for making a single-pole connection device for power contacts, in particular for high-current electricity. The plug and the socket then have only one contact each, ignoring any pilot contacts, with the contact of the plug being provided, for example, with a crimping head having a cable crimped thereon or therein. This single connection embodiment, which is the solution to the original problem submitted to the inventors, indeed shows further the fundamental difference compared with the prior art of above-mentioned documents DE-196 38 157 or U.S. Pat. No. 5,759,069 A in which the object is, on the contrary, to make it possible to implement a multi-pole device in a small space.

Although the invention relates to a connection device formed by a socket and a plug suitable for co-operating with each other, it also relates to a plug or a socket taken separately and intended to make up such a connection device.

The invention also provides for an electrical connection device comprising a socket comprising at least one axial pressure contact arranged in insulation and at least one annular groove and a plug comprising at least one tubular contact that is coaxial about a direction of coupling of the plug with the socket. The at least one tubular contact comprises a leading end having an end surface and is structured and arranged to co-operate with the at least one axial pressure contact of the socket. The at least one annular groove opens out axially and is structured and arranged to receive therein the at least one tubular contact. At least a portion of the end face of the leading end of the at least one tubular contact presses against the at least one axial pressure contact when the at least one tubular contact is positioned in the at least one annular groove and when the plug is coupled with the socket.

The electrical connection device may further comprise a pilot contact arranged in an inside space of at least one tubular contact of the plug. The electrical connection device may further comprise a pilot contact arranged in an inside space of at least one of the plug and the socket. The electrical connection device may comprise a single-pole connection device. The at least one tubular contact may comprise a single tubular contact. The at least one axial pressure contact may comprise a single axial pressure contact. The plug may comprise a crimping head having a cable crimped thereon or therein. The socket may comprise a crimping head having a cable crimped thereon or therein.

The invention also provides for an electrical connection system comprising a socket comprising an axial pressure contact, insulation, and a groove and a plug comprising a coaxially arranged tubular contact having a leading end. The groove is structured and arranged to receive therein the coaxially arranged tubular contact. At least a portion of the leading end of the coaxially arranged tubular contact presses axially against the axial pressure contact when the coaxially arranged tubular contact is positioned in the groove and when the plug is coupled with the socket.

The electrical connection system may further comprise a pilot contact arranged in an inside space of the plug. The electrical connection system may further comprise a pilot contact arranged in an inside space of the socket. The electrical connection system may be a single-pole connection device. The coaxially arranged tubular contact may comprise a single coaxially arranged tubular contact. The axial pressure contact may comprise a single axial pressure contact. The plug may comprise a crimping head having a cable crimped thereon or therein. The socket may comprise a crimping head having a cable crimped thereon or therein. The groove may comprise an annular groove.

The invention also provides for an electrical connection system comprising a socket comprising insulation, a groove, and an axial pressure contact comprising a surface. The groove is arranged between a front end of the insulation and the surface. A plug comprises a tubular contact having a leading end. The groove is structured and arranged to receive therein the tubular contact. The leading end of the tubular contact presses axially against the surface of the axial pressure contact when the tubular contact is positioned in the groove.

The leading end of the tubular contact may press against the annular surface of the axial pressure contact when the plug is coupled with the socket. The groove may comprise an annular groove and the surface may comprise an annular surface. The electrical connection system may further comprise at least one of the plug further comprises a tubular case arranged to surround the tubular contact and a coaxially arranged pilot contact arranged within the tubular contact and the socket further comprises a tubular case arranged to surround a front portion of the insulation and a contact arranged within a passage structured and arranged to receive therein a coaxially arranged pilot contact of the plug.

BRIEF DESCRIPTION OF THE DRAWINGS

The invention will be well understood on reading the following description made with reference to the accompanying drawings, in which.

DETAILED DESCRIPTION OF THE PRESENT INVENTION

Figure 1:
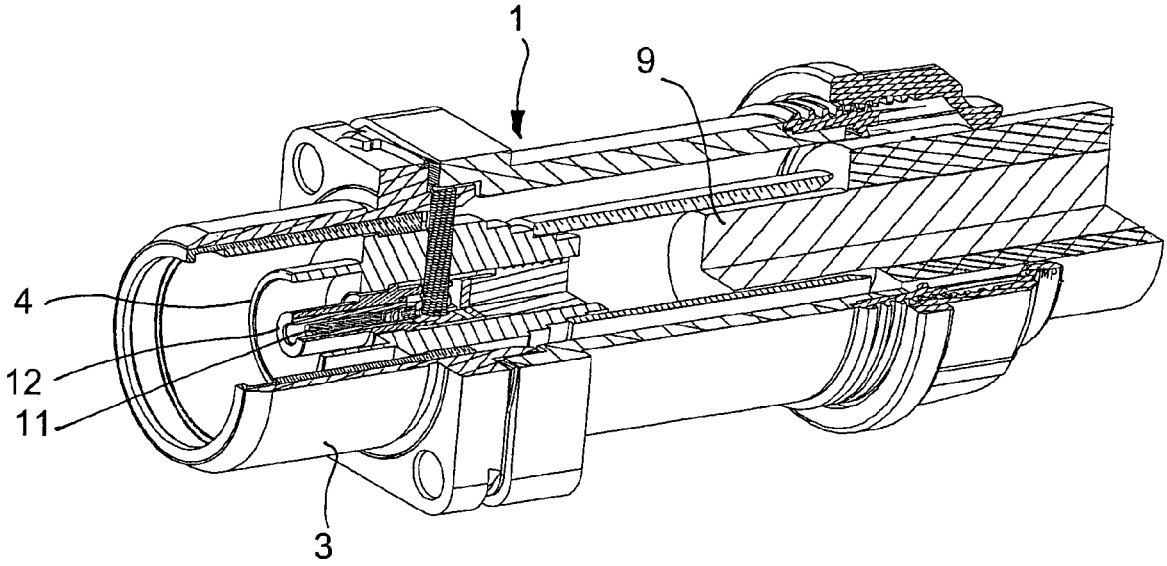
FIGS. 1 and 2 show a plug of the invention in perspective, and partially in section for FIG. 1.

By way of example, and because the invention is particularly well adapted to devices of this type, the embodiment shown is a single-pole connection device, i.e. each of the plug 1 and the socket 2 constituting the device includes only a single power contact (live, neutral, ground, . . . ).

In addition, there is shown herein a device of the cable coupler type, i.e. having a socket and a plug that are both portable, the socket constituting a "connector" in the terminology of international standards. The socket and the plug of the cable coupler are for coupling together by various mechanical means so as to establish an electrical connection between their contacts.

It is thus for reasons of simplicity that the words "socket" and "plug" are used, however it is clear that the socket could be fixed to constitute a socket-outlet in the terminology of international standards, or on the contrary, the plug could be fixed and constitute an appliance inlet according to said standards.

As can be seen clearly in the drawings, the plug 1 comprises a tubular case 3, receiving in this example a single power contact 4 in its inside space, the contact being in the very particular shape of a ring or tube that is made entirely out of conductive material.

The socket 2 is also provided with a case 5 designed to receive the case 3 of the plug which can be inserted in said socket case during coupling.

Figure 3:
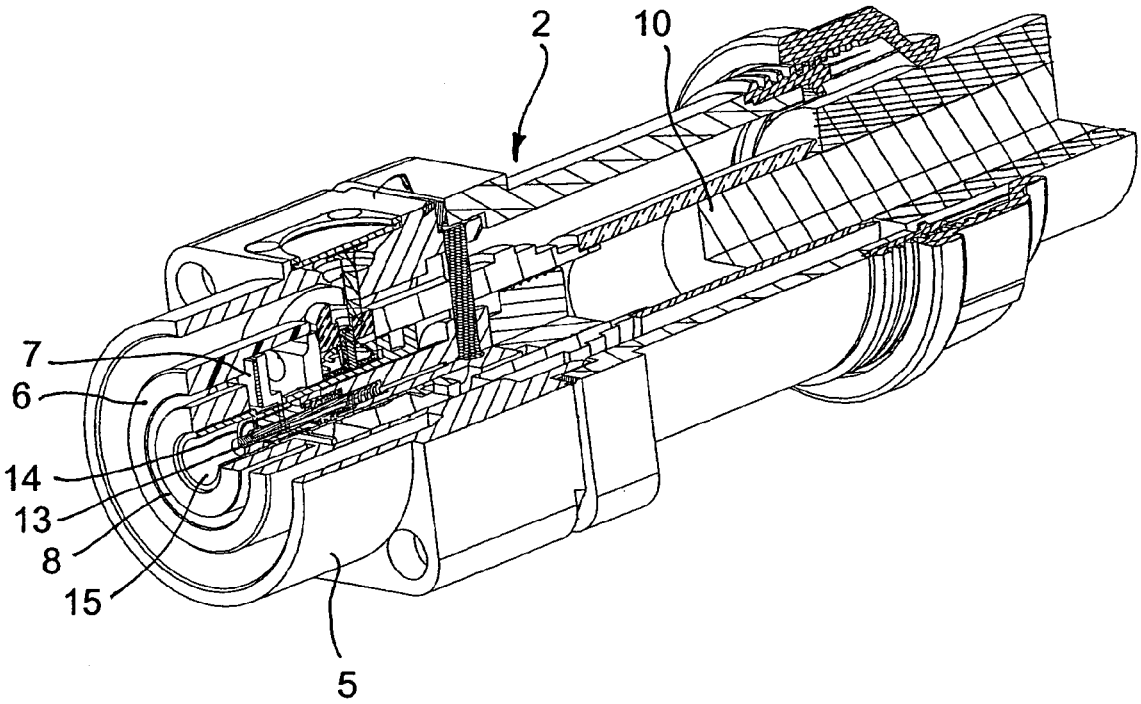
FIGS. 3 and 4 show a socket of the invention in perspective, and partially in section for FIG. 3, the socket being for coupling with the plug of FIGS. 1 and 2.
Figure 4:
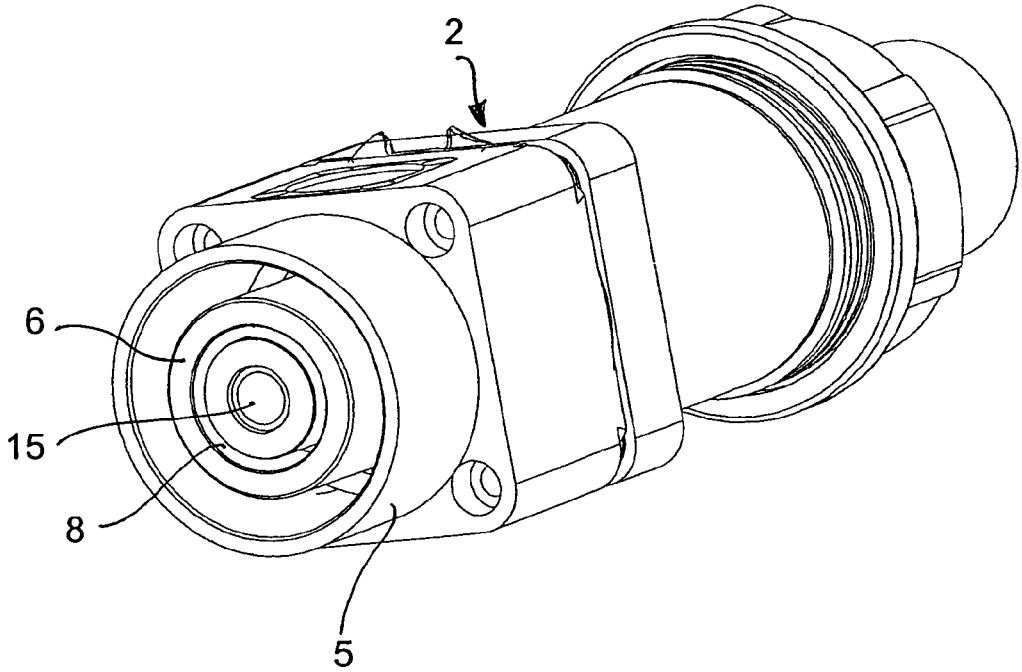

Inside its case 5, the socket 2 presents insulation 6 which protects access to a contact 7 of the socket (FIGS. 3 and 4).

The contact 7 of the socket 2 in this case is in the form of an eccentric flexible blade constituting a spring and/or provided with a spring.

The axial-pressure contact 7 of the socket is accessible to the contact 4 of the plug via a passage 8 formed through the insulation 6 of said socket so that the end face of the tubular contact can press against the contact of the socket in such a manner as to form an end contact under pressure.

To this end, the passage 8 in the socket 2 is in the form of an annular groove which opens out axially, at least in part, to face the contact 7 of said socket.

The tubular contact 4 of the plug is provided in this case with a crimping head having a cable 9 (FIG. 1) crimped therein or thereon, the socket likewise being provided in this case with a cable 10 (FIG. 3).

Figure 2:
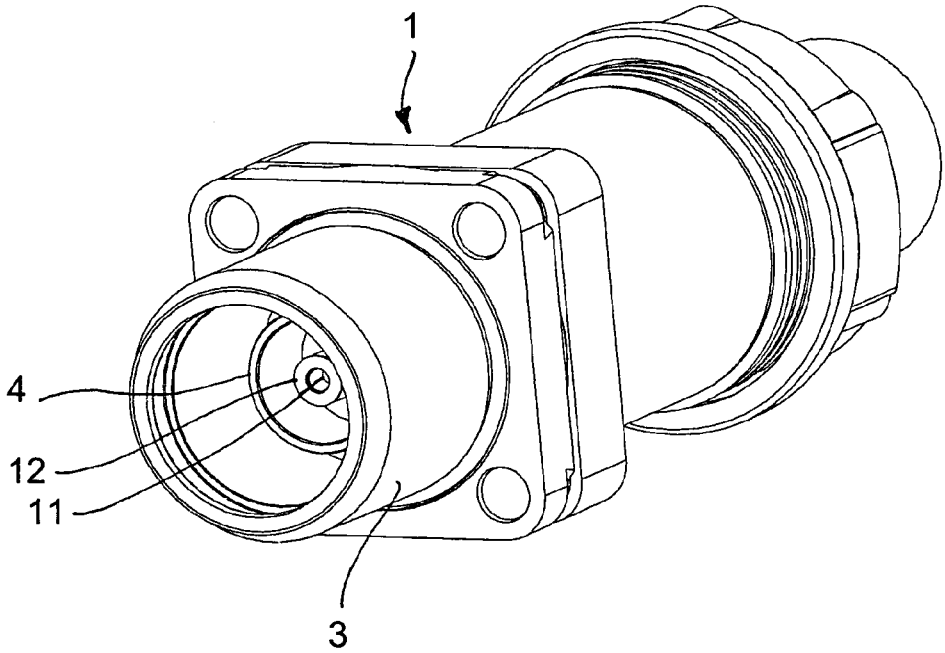
Figure 5:
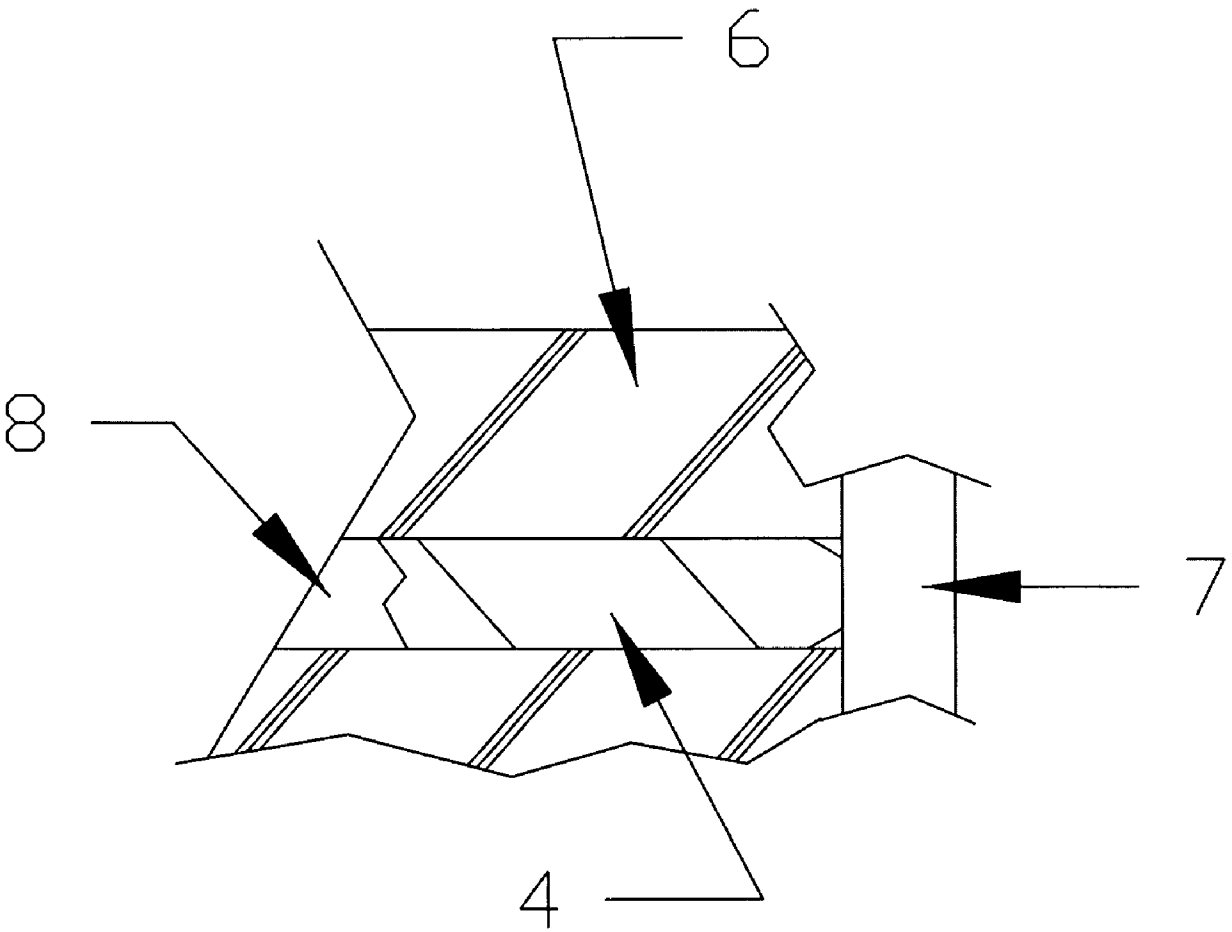
FIG. 5 shows an enlarged partial sectional view of the tubular contact of the plug arranged within the annular groove and pressing against the axial pressure contact of the socket.

It will also be understood that in addition to possible lack of any angular orientation being required for the plug relative to the socket for coupling purposes, the plug 1 of FIGS. 1 and 2 can couple with the socket 2 of FIGS. 3 and 4 only on the condition that the diameter and the thickness of the tubular contact 4 of said plug correspond respectively to the diameter and the thickness of the annular groove 8 in the insulation 6 of the socket 2 (see FIG. 5).

Thus, depending on the nature of the electricity to be conveyed by the socket, it is possible to prevent inappropriate coupling of a plug that is not provided with a compatible tubular contact.

In addition, and as mentioned above, one of the numerous advantages of such a tubular contact 4 is that it enables an empty space to be released which can be used in particular to receive, by way of example, one or more pilot contacts (e.g. for the purpose of remotely controlling the passage of electricity) such as the coaxial pilot contacts 11 and 12 of the plug 1 shown in FIGS. 1 and 2 which are designed to co-operate with opposing contacts 13, 14 of the socket 2 (FIGS. 3 and 4).

The pilot contacts 11, 12 of the plug 1 in this example pass via an additional passage 15 formed in the insulation 6 of the socket 2 (FIGS. 3 and 4).

As also mentioned above, the invention relates to many embodiments other than the embodiment described, having one or more contacts.

As a result, in addition to all of the advantages of end pressure contacts, the tubular contact(s) of a plug associated with the annular groove(s) of a socket provide the above-mentioned advantages concerning protection for the standardized test finger, since the or each passage 8 in the form of an annular groove in a socket is designed to pass only one tubular contact 4 of the corresponding plug.

What is claimed is:

1. An electrical connection device comprising:

a socket comprising at least one axial pressure contact arranged in insulation and at least one annular groove defined by spaced apart inner and outer portions of the insulation;

a plug comprising at least one tubular contact that is coaxial about a direction of coupling of the plug with the socket;

the at least one tubular contact comprising an open leading end having an end surface and being structured and arranged to co-operate with the at least one axial pressure contact of the socket; and the at least one annular groove opening out axially and being structured and arranged to receive therein the at least one tubular contact, wherein at least a portion of the end surface of the leading end of the at least one tubular contact presses against the at least one axial pressure contact when the at least one tubular contact is positioned in the at least one annular groove and when the plug is coupled with the socket.

2. The electrical connection device of claim 1, further comprising a pilot contact arranged in an inside space of at least one tubular contact of the plug.

3. The electrical connection device of claim 1, further comprising a pilot contact arranged in an inside space of at least one of the plug and the socket.

4. The electrical connection device of claim 1, wherein the electrical connection device comprises a single-pole connection device.

5. The electrical connection device of claim 1, wherein the at least one tubular contact comprises a single tubular contact.

6. The electrical connection device of claim 1, wherein the at least one axial pressure contact comprises a single axial pressure contact.

7. The electrical connection device of claim 1, wherein the plug is adapted to be connected to a cable.

8. The electrical connection device of claim 1, wherein the socket is adapted to be connected to a cable.

9. The electrical connection device of claim 1, wherein a thickness and a diameter of said tubular contact respectively corresponds to a thickness and a diameter of said annular groove.

10. An electrical connection system comprising:

a socket comprising an axial pressure contact, insulation, and an annular groove defined by spaced apart inner and outer portions of the insulation;

a plug comprising a coaxially arranged tubular contact having an open leading end; and the annular groove being structured and arranged to receive therein the coaxially arranged tubular contact, wherein at least a portion of the leading end of the coaxially arranged tubular contact presses axially against the axial pressure contact when the coaxially arranged tubular contact is positioned in the annular groove and when the plug is coupled with the socket.

11. The electrical connection system of claim 10, further comprising a pilot contact arranged in an inside space of the plug.

12. The electrical connection system of claim 10, further comprising a pilot contact arranged in an inside space of the socket.

13. The electrical connection system of claim 10, wherein the electrical connection system is a single-pole connection device.

14. The electrical connection system of claim 10, wherein the coaxially arranged tubular contact comprises a single coaxially arranged tubular contact.

15. The electrical connection system of claim 10, wherein the axial pressure contact comprises a single axial pressure contact.

16. The electrical connection system of claim 10, wherein the plug is adapted to be connected to a cable.

17. The electrical connection system of claim 10, wherein the socket is adapted to be connected to a cable.

18. The electrical connection system of claim 10, wherein a thickness and a diameter of said tubular contact respectively corresponds to a thickness and a diameter of said annular groove.

19. An electrical connection system comprising:

a socket comprising insulation, an annular groove, and an axial pressure contact comprising an annular surface;

the annular groove being defined by spaced apart inner and outer portions of the insulation and being arranged between a front end of the insulation and the annular surface;

a plug comprising a tubular contact having an open leading end; and the annular groove being structured and arranged to receive therein the tubular contact, wherein at least a portion of the leading end of the tubular contact presses axially against the annular surface of the axial pressure contact when the tubular contact is positioned in the annular groove.

20. The electrical connection system of claim 19, wherein the leading end of the tubular contact presses against the annular surface of the axial pressure contact when the plug is coupled with the socket.

21. The electrical connection system of claim 19, further comprising at least one of:

the plug further comprises a tubular case arranged to surround the tubular contact and a coaxially arranged pilot contact arranged within the tubular contact; and the socket further comprises a tubular case arranged to surround a front portion of the insulation and a contact arranged within a passage structured and arranged to receive therein a coaxially arranged pilot contact of the plug.

* * * * *